US008542154B2

(12) United States Patent
You et al.

(10) Patent No.: US 8,542,154 B2
(45) Date of Patent: Sep. 24, 2013

(54) PORTABLE TERMINAL

(75) Inventors: Chisang You, Gyeonggi-Do (KR); Moonsoo Song, Gyeonggi-Do (KR); Jaehyun Choi, Seoul (KR); Songyi Lee, Gyeonggi-Do (KR); Namyong Kim, Seoul (KR); Yochuol Ho, Gyeonggi-Do (KR); Euntaek Jeoung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 12/829,134

(22) Filed: Jul. 1, 2010

(65) Prior Publication Data

US 2011/0001673 A1 Jan. 6, 2011

(30) Foreign Application Priority Data

Jul. 2, 2009 (KR) ..... 10-2009-0060349
Jul. 20, 2009 (KR) ..... 10-2009-0066027

(51) Int. Cl.
*H01Q 1/24* (2006.01)

(52) U.S. Cl.
USPC ..... 343/702

(58) Field of Classification Search
USPC ..... 343/702, 700 MS, 803; 455/575.7
See application file for complete search history.

(56) References Cited

U.S. PATENT DOCUMENTS

| | | | | |
|---|---|---|---|---|
| 6,853,341 | B1 * | 2/2005 | Hellgren et al. | 343/742 |
| 7,307,591 | B2 * | 12/2007 | Zheng | 343/702 |
| 7,358,906 | B2 * | 4/2008 | Sato et al. | 343/702 |
| 7,605,764 | B2 * | 10/2009 | Ishimiya | 343/702 |
| 2007/0115200 | A1 * | 5/2007 | Ishimiya | 343/803 |
| 2009/0239595 | A1 * | 9/2009 | Sung et al. | 455/575.7 |

* cited by examiner

*Primary Examiner* — Huedung Mancuso
(74) *Attorney, Agent, or Firm* — Birch, Stewart, Kolasch & Birch, LLP

(57) ABSTRACT

A portable terminal comprises a ground portion mounted in a body of the portable terminal, and configured to form electrical ground of a circuit board which controls the portable terminal, a conductive member mounted to a case which forms appearance of the body, and formed of a conductive material, a first radiator electrically connected to the ground portion so as to be fed by the ground portion, and configured to transmit and receive radio electromagnetic waves, a second radiator formed of a conductive material, and connected to the conductive member so as to form an antenna pattern together with the ground portion and the conductive member, the antenna pattern consecutive with a feed point of the first radiator, and a connection member configured to electrically connect edges of the ground portion to the conductive member such that the first radiator and the antenna pattern form a dipole antenna.

19 Claims, 14 Drawing Sheets

PORTABLE TERMINAL

CROSS-REFERENCE TO A RELATED APPLICATION

This application claims the benefit of priority of Korean Application No. 10-2009-0060349 and Korean Application No. 10-2009-0066027, both filed on Jul. 2, 2009 and Jul. 20, 2009 respectively, both of which are herein expressly incorporated by reference in their entireties.

BACKGROUND OF THE INVENTION

1. Field of the Invention

The present invention relates to a portable terminal, and particularly, to a portable terminal having an antenna for transmitting or receiving radio electromagnetic waves.

2. Background of the Invention

In general, a terminal may be classified into a mobile (portable) terminal and a stationary terminal according to a moveable state. The mobile terminal may be also classified into a handheld terminal and a vehicle mount terminal according to a user's carriage method.

As functions of the terminal become more diversified, the terminal can support more complicated functions such as capturing images or video, reproducing music or video files, playing games, receiving broadcast signals, and the like. By comprehensively and collectively implementing such functions, the mobile terminal may be embodied in the form of a multimedia player or device.

Various attempts have been made to implement complicated functions in such a multimedia device by means of hardware or software. For instance, a User Interface (UI) environment is provided in a portable terminal to enable a user to easily and conveniently search for or select a desired function among available functions.

Besides, a method for enhancing a function of the hardware may be considered, and a function of an antenna of the portable terminal may be enhanced.

SUMMARY OF THE INVENTION

Therefore, an object of the present invention is to provide a portable terminal having an antenna capable of reinforcing an intensity of a body and transceiving (transmitting and receiving) radio electromagnetic waves.

Another object of the present invention is to provide a portable terminal having an antenna capable of transmitting and receiving radio electromagnetic waves of multi bands.

Still another object of the present invention is to provide a portable terminal having an antenna of a slimmer size.

To achieve these and other advantages and in accordance with the purpose of the present invention, as embodied and broadly described herein, there is provided a portable terminal, comprising: a ground portion mounted in a body of the portable terminal, and configured to form electrical ground of a circuit board which controls the portable terminal; a conductive member mounted to a case which forms appearance of the body, and formed of a conductive material; a first radiator electrically connected to the ground portion so as to be fed by the ground portion, and configured to transmit and receive radio electromagnetic waves; a second radiator formed of a conductive material, and connected to the conductive member so as to form an antenna pattern together with the ground portion and the conductive member, the antenna pattern consecutive with a feed point of the first radiator; and a connection member configured to electrically connect edges of the ground portion to the conductive member such that the first radiator and the antenna pattern form a dipole antenna.

Here, at least one of the first and second radiators may be patterned on a surface of the case.

According to one embodiment of the present invention, the edge of the ground portion, the conductive member and the connection member may form a conductive loop. The conductive loop may form a closed loop. The first and second radiators may be connected to different parts of the closed loop. The conductive loop may transmit and receive radio electromagnetic waves of a frequency band different from that of the dipole antenna by being combined with the first radiator. The portable terminal may further comprise a third radiator. The third radiator may be electrically connected to the conductive loop so as to form an antenna together with the first radiator, the antenna which transmits and receives a frequency band different from that of the dipole antenna.

According to another embodiment of the present invention, the connection member may be protruding from the conductive member, and may elastically pressurize a connection port provided at the circuit board. The conductive member may be formed along edges of the body so as to form a frame of the body.

According to another embodiment of the present invention, the ground portion may include a conductive supporting member configured to support a display module which displays image information. And, the conductive supporting member may be provided with a connection port electrically connected to the connection member.

According to another aspect of the present invention, there is provided a portable terminal, comprising: a body having a display unit for displaying image information; a conductive frame portion mounted to a case which forms appearance of the body, and formed along edges of the body; a ground portion configured to form electrical ground of a circuit board which controls the display unit; a conductive connection portion configured to connect the ground portion and the conductive frame portion to each other at a plurality of locations so as to form slots together with the ground portion and the conductive frame portion; and a feeding portion configured to feed the slot such that the slot radiates electromagnetic waves. The portable terminal may further comprise an insulating portion configured to cover the conductive frame portion, and formed of an insulating material.

According to another embodiment of the present invention, the conductive frame portion may be formed to encompass the ground portion when projected in a direction perpendicular to the display unit. The conductive frame portion may include side frames and a connection frame. The side frames may be formed along two edges of the display unit, and the connection frame may be formed in a direction crossing the two edges of the display unit thereby to connect the side frames to each other. The conductive frame portion may be configured to form a closed loop.

According to another embodiment of the present invention, the ground portion may be formed at the circuit board, or at the conductive member which supports a display module. The conductive connection portion may connect the conductive frame portion and the ground portion to each other such that the slot is formed in plurality in number. The plurality of slots may be formed to transmit and receive radio electromagnetic waves of different frequency bands.

According to another embodiment of the present invention, the conductive connection portion may be extending from the conductive frame portion, and may elastically pressurize the connection port provided at the circuit board. The feeding portion may be implemented as a pattern formed of a conductive material, and may be electrically connected to the ground portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
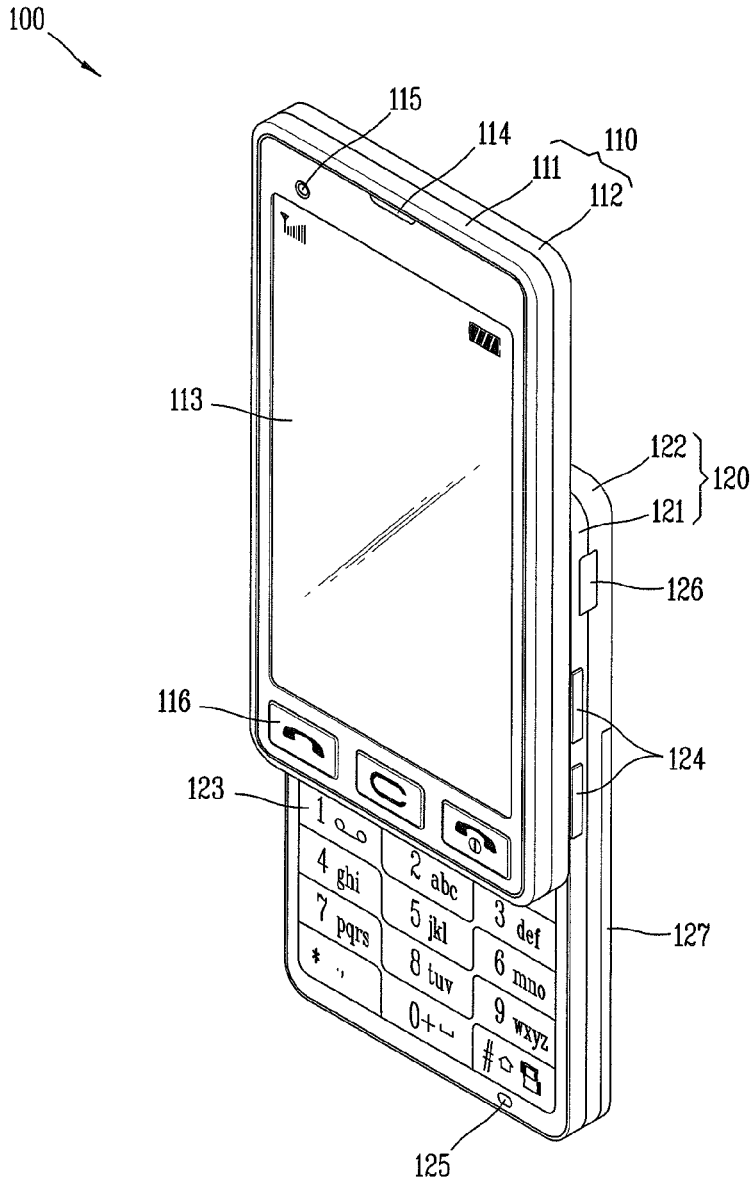
FIG. 1 is a perspective view of a portable terminal according to one embodiment of the present invention.

Description will now be given in detail of the present invention, with reference to the accompanying drawings.

For the sake of brief description with reference to the drawings, the same or equivalent components will be provided with the same reference numbers, and description thereof will not be repeated.

Hereinafter, a portable terminal according to the present invention will be explained in more detail.

The same reference numerals will be given to the same components as those of the aforementioned embodiment, and their explanations will be omitted. The singular expression of the present invention may include a plural concept unless distinctively differently defined.

The portable terminal according to the present invention may include a portable phone, a smart phone, a laptop computer, a digital broadcasting terminal, Personal Digital Assistants (PDA), Portable Multimedia Player (PMP), a navigation system, etc.

FIG. 1 is a perspective view of a portable terminal according to one embodiment of the present invention.

A body of the portable terminal 100 of the present invention comprises a first body 110, and a second body 120 coupled to the first body 110 by being slid along at least one direction. The present invention may not be limited to the slide type portable terminal, but may be applied to various types such as a bar type, a folder type, a swing type, and a swivel type.

A state that the first body 110 completely overlaps the second body 120 may be referred to as a 'closed configuration', whereas a state that one or more parts of the second body 120 are exposed by the first body 110 may be referred to as an 'opened configuration'.

Under the closed configuration, the portable terminal is operated in a standby mode. However, the standby mode may be released by a user's manipulation. On the contrary, under the opened configuration, the portable terminal is operated in a call mode, etc. The call mode may be converted into the standby mode by a user's manipulation or after time lapses.

A case forming the appearance of the first body 110 (casing, housing cover, etc.) is formed by a front case 111 and a rear case 112. Each kind of electronic components are mounted in a space formed by the front case 111 and the rear case 112. If desired, one or more intermediate cases may be provided between the front case 111 and the rear case 112. The front and rear cases are usually formed by injection-molding resin material, or formed using metallic material such as stainless steel (STS) and titanium (Ti).

On the front case 111 of the first body 110, may be disposed a display unit 113, an audio output unit 114, a first image input unit 115 or a first manipulation unit 116.

The display unit 113 may be implemented as a Liquid Crystal Display (LCD) module or an Organic Light Emitting Diodes (OLED) module, a Transparent OLED (TOLED) module, and so on.

The display unit 113 may also be configured to further include a touch pad for allowing information to be input by a user's touch. And, the display unit 113 may be configured to generate various tactile effects when being touched by a user. This may be implemented by a haptic module interworking with the display unit 113. A representative tactile effect generated by the haptic module includes vibration. The haptic module may be variously arranged according to configuration aspects of not only the display unit 113, but also the portable terminal.

The audio output unit 114 may be implemented as a speaker or a receiver.

The first image input unit 115 may be implemented as a camera module configured to capture a user's still images or moving images.

The first manipulation unit 116 is configured to receive commands to control the operation of the portable terminal according to the present invention. The first manipulation unit 116 may be implemented as a touch screen together with the display unit 113.

Like the first body 110, a case of the second body 120 may be formed by a front case 121 and a rear case 122.

A second manipulation unit 123 may be disposed on a front surface of the front case 121 of the second body 120.

A third manipulation unit 124, a first audio input unit 125, and an interface 126 may be disposed on at least one of the front case 121 and the rear case 122.

The first to third manipulation units 116, 123 and 124 may be referred to as a manipulation unit, and may include any type of ones that can be manipulated in a user's tactile manner.

The manipulation unit may be implemented as dome switches or a touch pad for receiving commands or information by a user's push or touch operation, or may be implemented as a jog wheel or a joystick.

In the aspect of functions, the first manipulation unit 116 may be used to input commands such as START, END, and SCROLL, and the second manipulation unit 123 may serve numbers, characters, symbols, etc. And, the third manipulation unit 124 may serve as hot keys for performing specific functions such as activation of the first image input unit 115.

The first audio input unit 125 may be implemented as a microphone so as to receive a user's voice or another sounds.

The interface 126 may serve as a passage through which the portable terminal of the present invention exchanges data with an external device. For instance, the interface 126 may be implemented as at least one of a wired/wireless connection port for connecting an earphone to the portable terminal, a short-range communications port (e.g., an Infrared Data Association (IrDA) port, a Bluetooth port, a wireless LAN port, etc.), power supply ports for providing power to the portable terminal, or the like.

The interface 126 may be configured using a card socket (e.g., for coupling to a memory card, a subscriber identity module (SIM) card, a user identity module (UIM) card, etc.).

Figure 2:
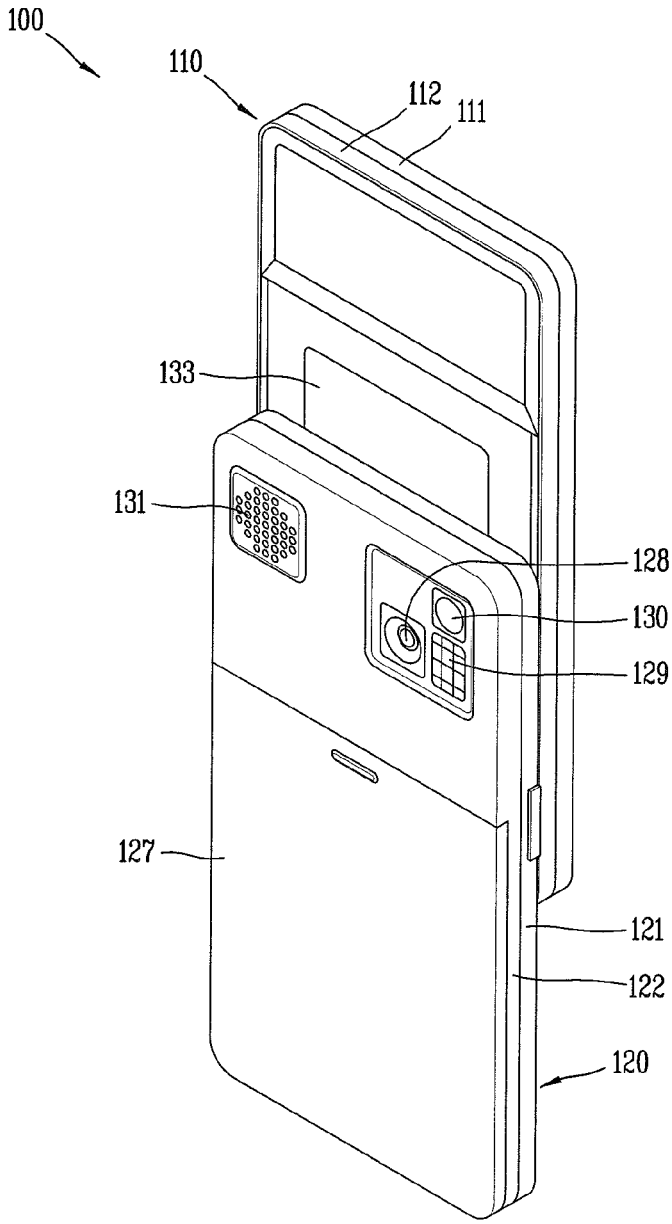
FIG. 2 is a rear perspective view of the portable terminal of FIG. 1.

A power supply unit 127 for supplying power to the portable terminal is mounted at the rear case 122. The power supply unit 127 may be a rechargeable battery, for example, to be detachably mounted to the rear case 122 for charging. FIG. 2 is a perspective view of a rear surface of the portable terminal of FIG. 1.

Referring to FIG. 2, a second image input unit 128 may be additionally mounted to a rear surface of the rear case 122. The second image input unit 128 faces a direction which is opposite to a direction faced by the first image input unit 115 (refer to FIG. 1), and may have pixels different from those of the first image input unit 115.

For example, the first image input unit 115 may operate with relatively lower pixels (lower resolution). Thus, the first image input unit 115 may be useful when a user can capture his face and send it to a calling party in a video call mode or the like. On the other hand, the second image input unit 128 may operate with a relatively higher pixels (higher resolution) such that it can be useful for a user to obtain higher quality pictures for later use.

A flash 129 and a mirror 130 may be additionally disposed adjacently to the second image input unit 128. When capturing an object by using the second image input unit 128, the flash 129 provides light to the object. The mirror 130 can cooperate with the second image unit 128 to allow a user to photograph himself or herself in a self-portrait mode.

It was explained that the second image input unit 128 is disposed at the second body 120. However, the position of the second image input unit 128 is not limited to the second body 120. For instance, at least one of the components 128 to 131 originally disposed at the rear case 122 may be mounted to the rear case 112 of the first body 110. In this case, the components disposed at the rear case 112 may be protected by the second body 120 in the closed configuration. Furthermore, even if the second image input unit 128 is not additionally provided, the first image input unit 115 configured to be rotatable may capture an image even in a capturing direction by the second image input unit 128.

A second audio output unit 131 may be additionally disposed at the rear case 122.

The second audio output unit 131 may implement a stereo function together with the first audio output unit 114 (refer to FIG. 1), and may be used for calling in a speaker phone mode.

An antenna for calling, Bluetooth communication or GPS communication, etc. may be provided at the terminal body. A broadcast signal receiving antenna 132 as well as the antenna may be disposed at the rear case 112. The broadcast signal receiving antenna 132 may be configured to retract into the first body 110.

One portion of a slide module 133 that slidably couples the first body 110 and the second body 120 to each other is disposed at the rear case 112 of the first body 110. Another portion of the slide module 133 is disposed at the front case 121 of the second body 120, thereby not being exposed out.

Figure 3:
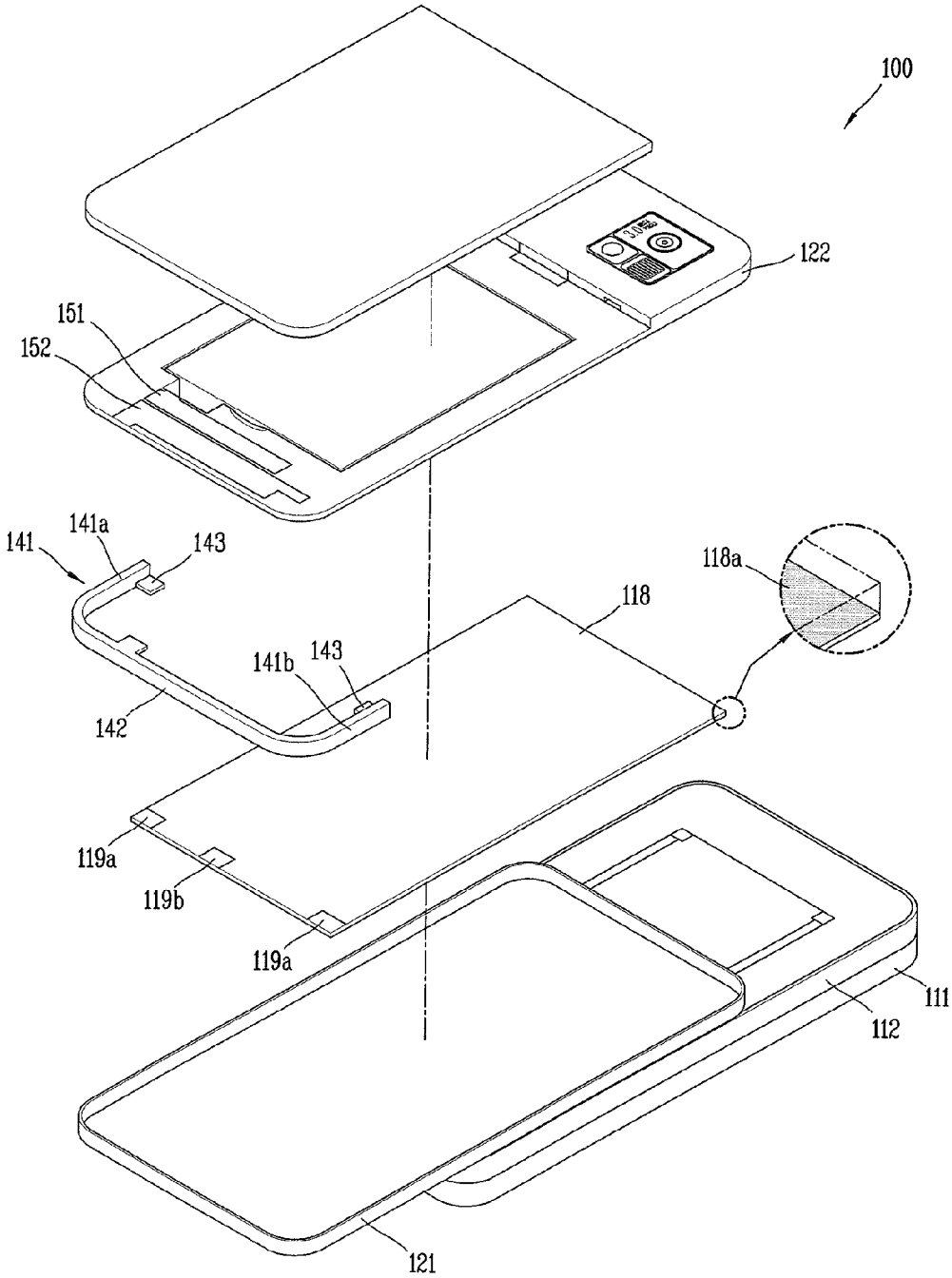
FIG. 3 is a rear disassembled view of a second body of FIG. 2.
Figure 4:
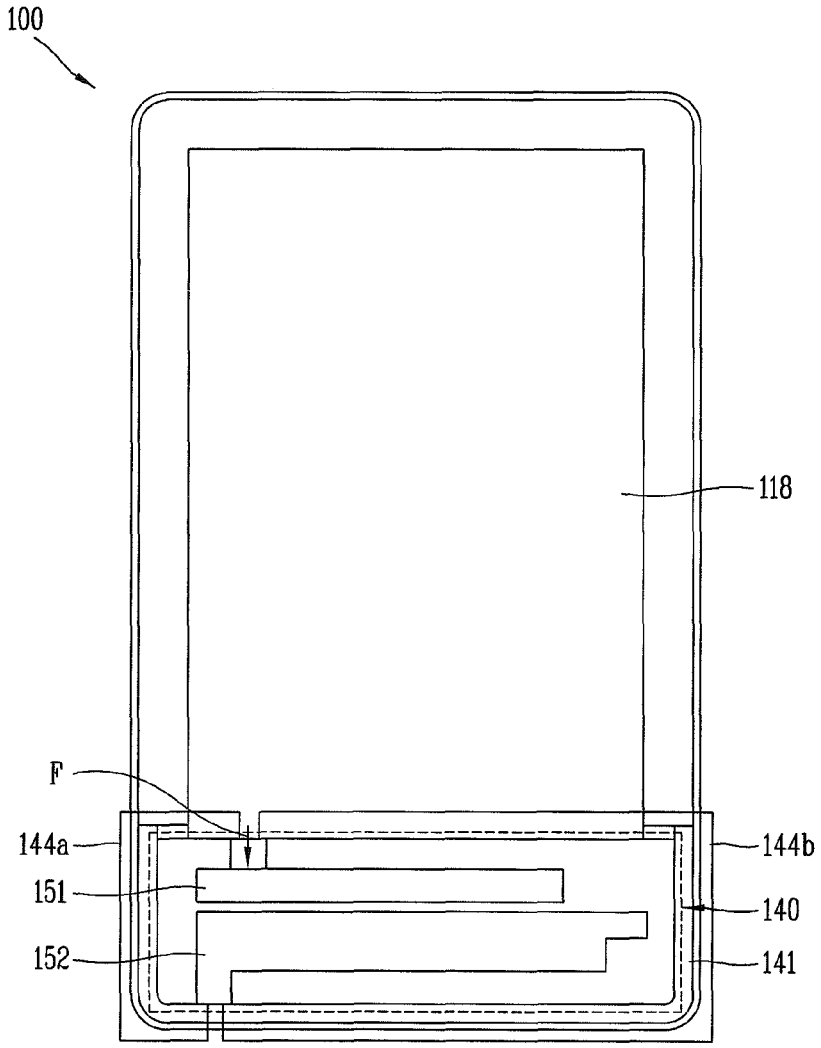
FIG. 4 is a conceptual view of a conductive loop formed by a conductive member, a ground portion and a connection member of FIG. 3.

FIG. 3 is a rear disassembled view of a second body 120 of FIG. 2, and FIG. 4 is a conceptual view of a conductive loop 140 formed by a conductive member 141, a ground portion 118*a*, and a connection member 142 of FIG. 3.

Referring to FIG. 3, a circuit board 118 is mounted to a front case 121 or a rear case 122 of the second body 120. The circuit board 118 may be configured as one example of a controller 170 (refer to FIG. 9) which controls the portable terminal so as to operate each kind of function of the portable terminal. The circuit board 118 processes signals corresponding to radio electromagnetic waves transmitted and received by the portable terminal.

The circuit board 118 may be formed in a plurality of layers, and at least one of the plurality of layers may be implemented as a ground portion 118*a* for forming electrical ground of the circuit board 118. The ground portion 118*a* may be formed as a thin film conductive material is coated on a first layer of the circuit board 118 so as to cover a circumferential surface of the circuit board 118.

A conductive member 141 is mounted to a front case 121 or a rear case 122 so as to reinforce an intensity of the second body 120. The conductive member 141 may be formed of a conductive material, e.g., a metallic thin plate formed of gold and copper.

Referring to FIG. 3, the conductive member 141 is mounted in the front case 121, and is formed along edges of the second body 120. However, the present invention is not limited to this. More concretely, the conductive member 141 may be mounted to an outer surface of the front case 121 or the rear case 122. The conductive member 141 and the front case 121 may be integrated with each other by double injection, etc.

The conductive member 141 includes side frames 141*a* and 141*b*, and a connection frame 142.

The side frames 141*a* and 141*b* are extendingly bent from both ends of the connection frame 142, and are arranged in a lengthwise direction of the portable terminal. The connection portion 142 is disposed in a widthwise direction of the portable terminal, and may be formed to be parallel to one corner of the circuit board 118, more concretely, one corner of the ground portion 118*a*. The conductive member 141 consisting of the side frames 141*a* and 141*b* and the connection frame 142 may be formed in a 'U' shape. However, the present invention is not limited to this. For instance, the conducive member 141 may form a closed loop along side surfaces of the front case 121.

The ground portion 118*a* and the conductive member 141 are electrically connected to each other by a connection member 143. A connection port 119*a* electrically connected to the ground portion 118*a* is mounted to the circuit board 118, and the connection member 143 electrically connects the conductive member 141 and the connection port 119*a* to each other.

The connection member 143 is protruding from the conductive member 141 towards the circuit board. The connection member 143 may be configured to pressurize the connection port 119*a* when the conductive member 141 has been mounted to a case. For instance, the connection member 143 may be implemented as a cantilever extending from the conductive member 141 and capable of being elastically transformed. A fixing end of the cantilever may be one end of the connection member 143 where the conductive member 141 and the connection member 143 are connected to each other, and a free end of the cantilever may be another end of the connection member 143. However, the present invention is not limited to this. More concretely, the connection member 143 may be implemented as an additional component, e.g., a conductive tape to electrically connect the connection port 119*a* and the conductive member 141 to each other.

Referring to FIGS. 3 and 4, the connection member 143 connects the ground portion 118*a* and the conductive member 141 at a plurality of locations so as to form the conducive loop 140 together with the ground portion 118*a* and the conductive member 141. The connection member 143 may be protruding from both ends of the conductive member 141 towards the circuit board 118, respectively. More concretely, a corner of the ground portion 118*a*, the conductive member 141, and the connection member 143 are electrically connected to one another to form a closed loop.

First and second radiators 151 and 152 for transmitting and receiving radio electromagnetic waves are connected to the conductive loop 140, respectively.

The first radiator 151 is electrically connected to the ground portion 118*a* so as to be fed by the ground portion 118*a*. And, the second radiator 152 is connected to the conductive member 141 so as to form a dipole antenna together with the first radiator 151.

For instance, the second radiator 152 is connected to the conductive member 141 so as to form an antenna pattern together with the ground portion 118*a* and the conductive member 141, the antenna pattern consecutive with a feed point of the first radiator 151. As the connection member 143 electrically connects the corner of the ground portion 118*a* to the conductive member 141, the first radiator 151 and the antenna pattern form a dipole antenna.

The first and second radiators 151 and 152 are implemented as thin bodies formed of conductive materials, and at least one of the first and second radiators 151 and 152 forms a pattern formed on a surface of the case. Referring to FIG. 3, each of the first and second radiators 151 and 152 forms a pattern on one surface of the rear case 122.

A feeding port 119*b* connected to the first radiator 151 is disposed on one end of the circuit board 118. The feeding port 119*b* is disposed so as to be adjacent to one end of the circuit board 118. The first radiator 151 may be formed such that one end thereof elastically pressurizes the feeding port 119*b*. For instance, the first radiator 151 may be provided with a free end extending towards the feeding port from one end of a pattern formed on the surface of the case. As the free end elastically pressurizes the feeding port 119*b*, the first radiator 151 and the feeding port 119*b* may be electrically connected to each other, and the first radiator 151 may be fed by the ground portion 118*a*.

The second radiator 152 may be extending from one end of a pattern formed on the surface of the case. For instance, the second radiator 152 may elastically pressurize the conductive member 141, or may be bonded to the conductive member 141 by a tape, etc.

Referring to FIG. 4, the first and second radiators 151 and 152 are connected to different parts of the conductive loop 140, a closed loop, respectively. Under this configuration, the conductive loop 140 forms first and second conductive paths 144*a* and 144*b* between the first and second radiators 151 and 152. The first conducive path 144*a* is formed to have a length shorter than that of the second conducive path 144*b*. The first and second radiators 151 and 152, and the first conductive path 144*a* form one dipole antenna having a feed point (F). Each of the first radiator 151, the second radiator 152 and the first conductive path 144*a* is formed to have a length corresponding to a ½ wavelength of a resonance frequency which is to be transmitted or received.

The conductive loop 140 is combined with the first radiator 151, thereby transmitting and receiving radio electromagnetic waves having a frequency band different from that of the dipole antenna formed by the first and second radiators 151 and 152 and the first conductive path 144*a*. The conductive loop 140 and the first radiator 141 form a monopole antenna.

Design factors of the first and second radiators 151 and 152 and the conductive loop 140, e.g., lengths, positions, etc. may be variable in a simple manner. This may allow the antenna for transmitting and receiving radio electromagnetic waves having multi bands to be easily designed. When the multi bands are assumed as first and second frequency bands, one of the first and second frequency bands may be higher than another of the first and second frequency bands.

For instance, the first frequency band may be less than 1000 Mhz (e.g., 800 Mhz to 1000 Mhz), and the second frequency band may be a frequency band allocated to a Global System for Mobile communication (GSM) scheme. The second frequency band may be more than 1600 Mhz (e.g., 1600 Mhz to 2200 Mhz).

Figure 5A:
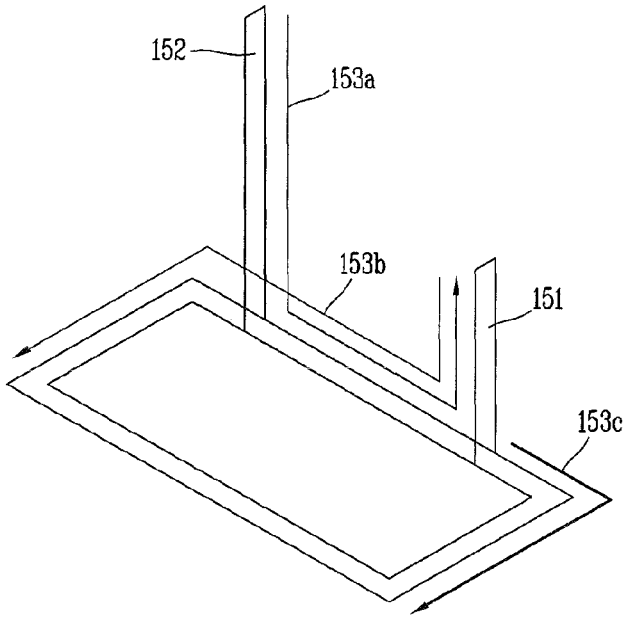
FIG. 5A is a brief conceptual view of an antenna of FIG. 3.
Figure 5B:
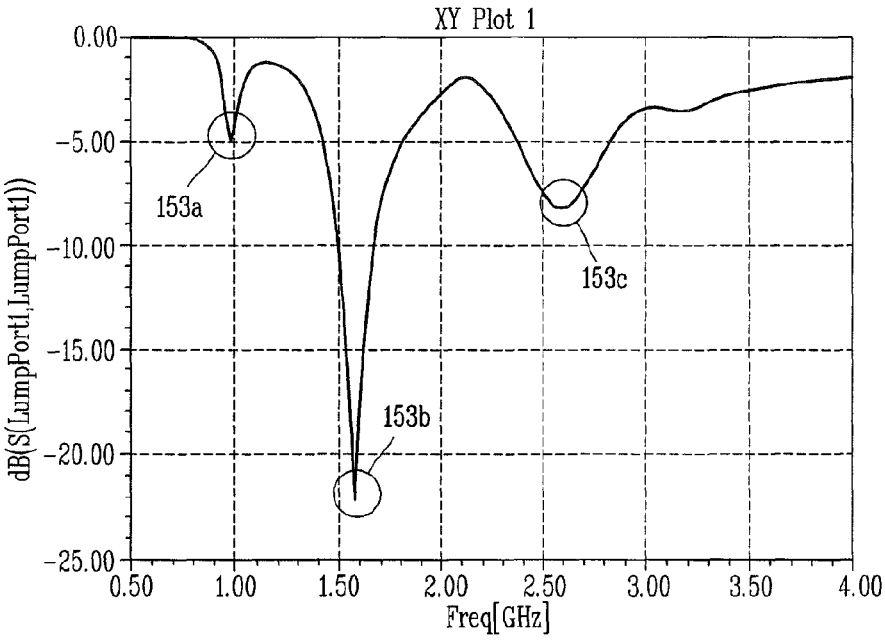
FIG. 5B illustrates a simulation result showing a resonance frequency of the antenna of FIG. 5A.

Hereinafter, characteristics of the antenna formed by the conductive loop 140 and the first and second radiators 151 and 152 will be explained with reference to FIGS. 5A and 5B. FIG. 5A is a brief conceptual view of an antenna of FIG. 3, and FIG. 5B illustrates a simulation result showing a resonance frequency of the antenna of FIG. 5A.

Referring to FIG. 5A, three types of current flows may be implemented as indicated by the arrows. A dipole antenna 153*a* is implemented by the first and second radiators 151 and 152 which form a first current flow. The first radiator 151 and the conductive loop 140 form a plurality of antennas 153*b* and 153*c* provided with second and third current flows. Referring to FIG. 5*b*, each of the antennas 153*a*, 153*b* and 153*c* has a resonance frequency.

Figure 6:
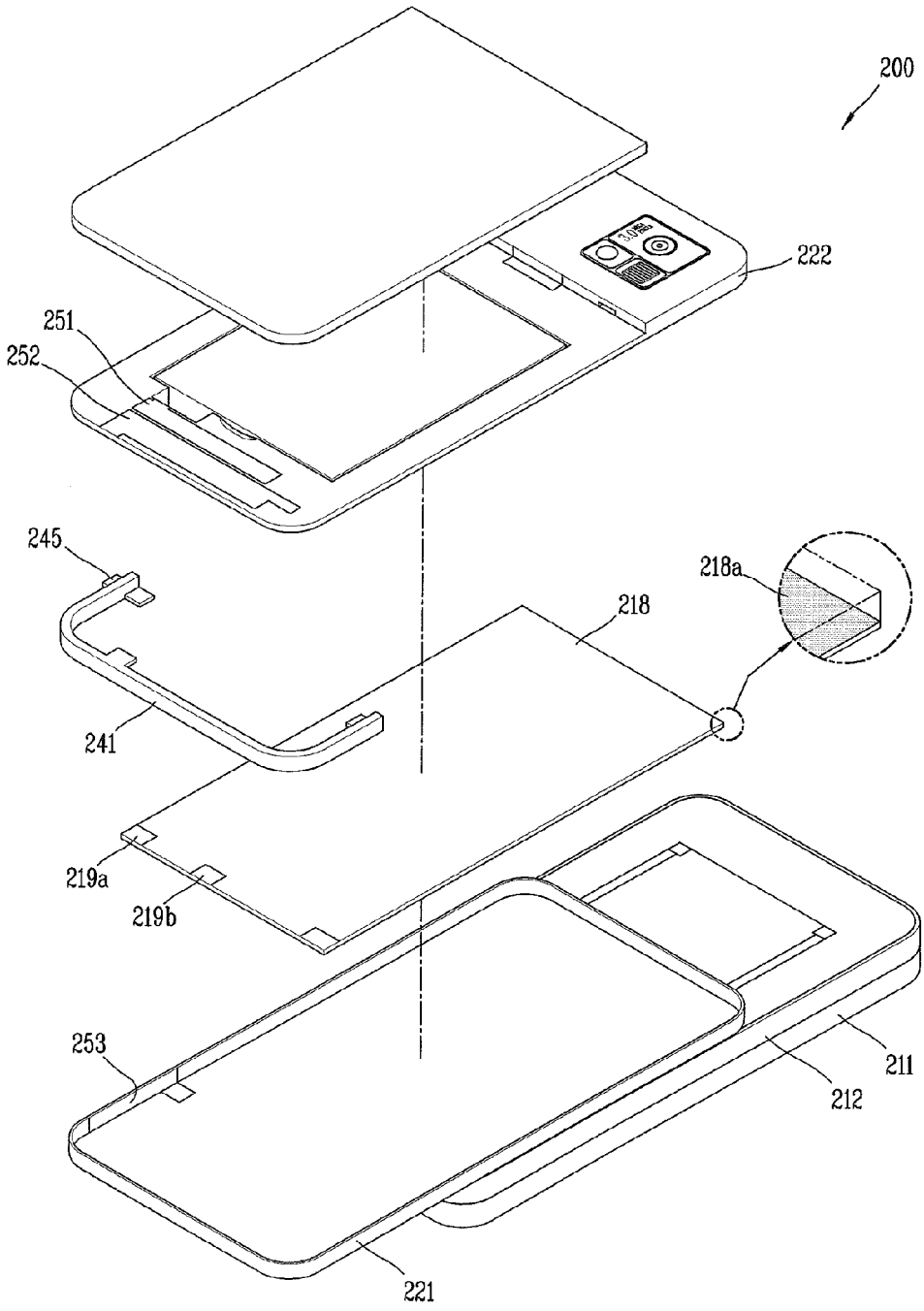
FIG. 6 is a disassembled view showing a modification example of a radiator according to the present invention.
Figure 7:
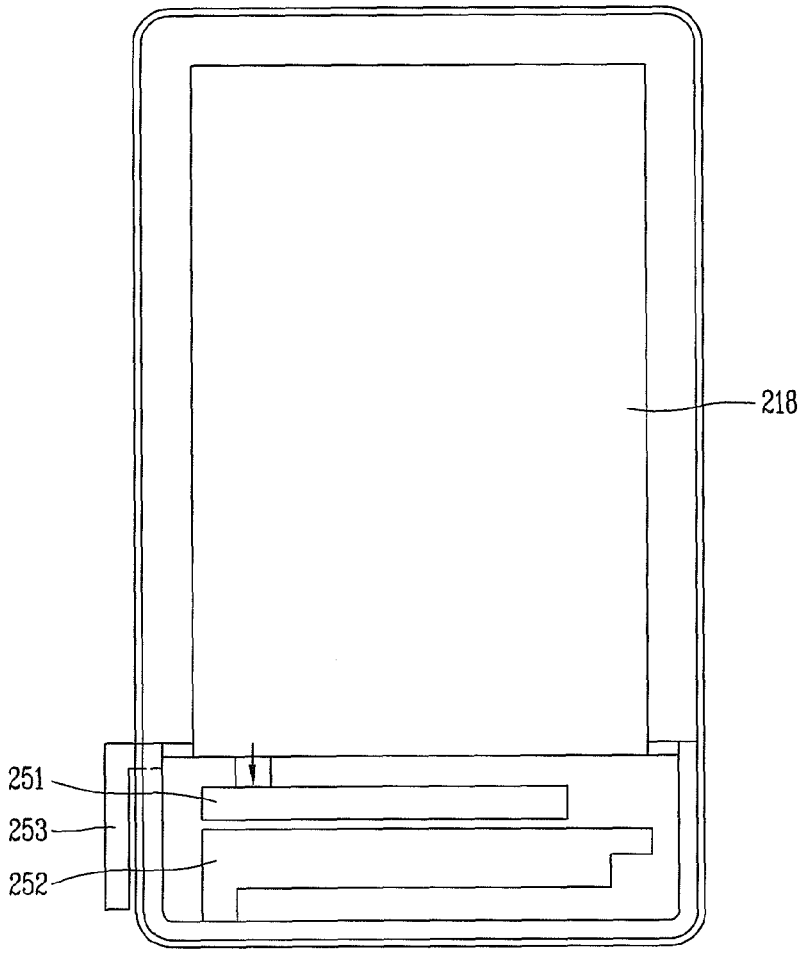
FIG. 7 is a conceptual view of a conductive loop formed by a conductive member, a ground portion and a connection member of FIG. 6.

FIG. 6 is a disassembled view showing a modification example of a radiator according to the present invention, and FIG. 7 is a conceptual view of a conductive loop 240 formed by a conductive member 241, a ground portion 218*a* and a connection member 242 of FIG. 6.

A first radiator 251 is connected to the ground portion 218*a* through a feeding port 219*b* so as to form a dipole antenna, and a second radiator 252 is connected to the conductive member 241 through a connection port 219*a*.

Referring to FIG. 6, a third radiator 253 is connected to the conductive member 241 so as to form an antenna together with the first radiator 251, the antenna configured to transmit and receive radio electromagnetic waves having a frequency band different from that of the dipole antenna. Under this configuration, the third radiator 253 is electrically connected to the conductive loop 240. For this connection, a protrusion member 245 contacting one end of the third radiator may be formed at the conductive member 241.

The third radiator 253 may be formed on a surface crossing a surface where the first radiator 251 is formed, i.e., a side surface of a rear case 212 or a surface parallel to the side surface. This may implement an antenna configured to transmit and receive radio electromagnetic waves having multi bands in a slimmer space.

Figure 8:
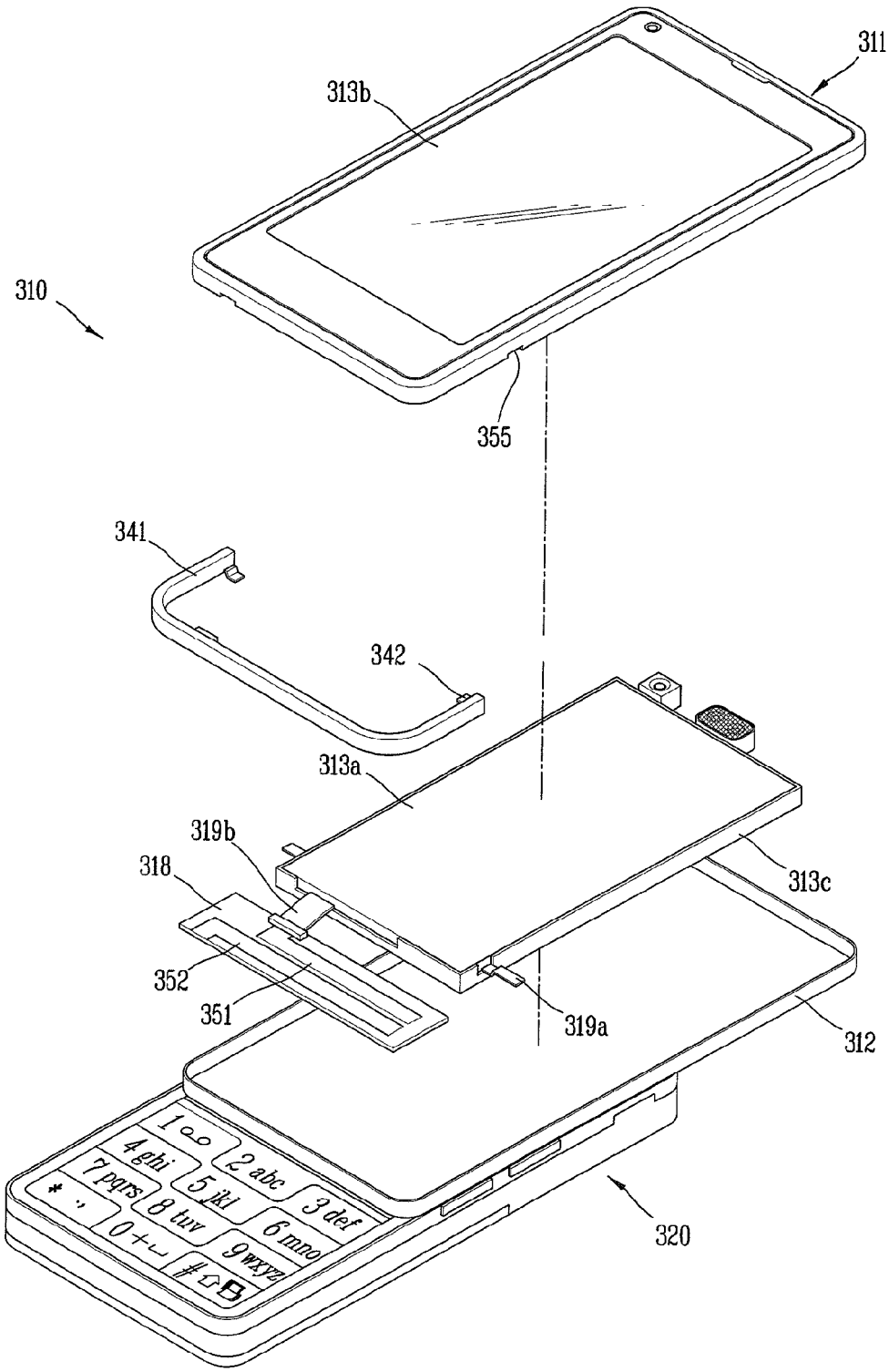
FIG. 8 is a front disassembled view of a portable terminal according to another embodiment of the present invention.
Figure 9:
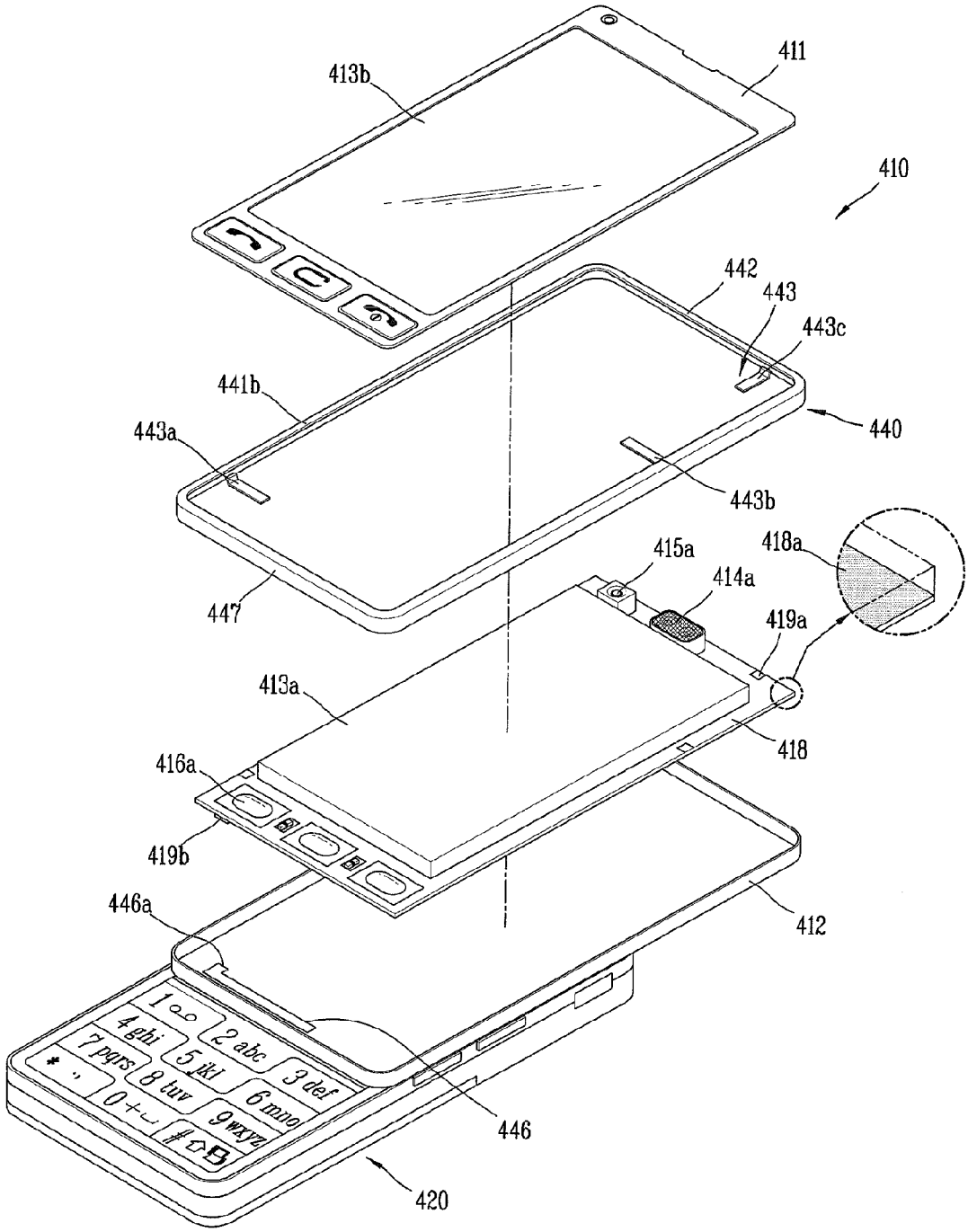
FIG. 9 is a disassembled view of a first body of a portable terminal according to another embodiment of the present invention.

FIG. 8 is a front disassembled view of a portable terminal according to another embodiment of the present invention, and FIG. 9 is a conceptual view of a conductive loop 340 formed by a conductive member 341, a ground portion 318*a*, and a connection member 342 of FIG. 8.

Referring to FIG. 8, a window 313*b* is mounted to one surface of a front case 311 of a first body 310.

The window 313*b* is formed of a light transmissive material, e.g., a synthetic resin, a reinforcing glass, etc. However, the window 313*b* may be formed to include a non-transmissive region. This non-transmissive region indicates a region formed of a non-transmissive material, or a region surface-processed so as to prevent light from passing therethrough.

The window 313*b* may have an area corresponding to a display module 313*a* so that visual information outputted from the display module 313*a* can be recognized from outside. The display module 313*a* and the window 313*b* are classified into the display unit 113 (refer to FIG. 1). Under this configuration, the display unit 113 for displaying visual information is formed at the center of the front case 311.

The display module 313*a* is mounted to a rear case 312, and is supported by a conductive supporting member 313*c*. The conductive supporting member 313*c* may be formed to cover a rear surface of the display module 313*a*, and may be electrically connected to a circuit board (not shown) so as to implement a ground portion of the circuit board. The circuit board may be laminated on the conductive supporting member 313*c* of the first body, or may be mounted to a second body 320.

The conductive member 341 is formed along edges of the first body 310 so as to configure a frame of the first body 310. Referring to FIG. 8, the conductive member 341 is mounted to an outer surface of the front case 311 so as to encompass the window 313*b*. The conductive member may be covered with an insulating member or an insulating coating layer. A through hole 355 is formed at the front case 311, and the connection member 342 extending from the conductive member 341 is extending to an inner space of the first body 310 by passing through the front case 311 via the through hole 355.

A connection port 319*a* electrically connected to the connection member 342 is formed at a corner of the conductive supporting member 313*c*.

Referring to FIG. 8, the connection member 342 is formed to contact the connection port 319*a*, thereby forming a conductive loop. First and second radiators 351 and 352 may be formed on a flexible circuit board 318, and the flexible circuit board 318 may be mounted to the rear case 312. The first and second radiators 351 and 352 are electrically connected to the conductive supporting member 313*c* and the conductive member 341, respectively. A feeding port 319*b* electrically connected to the first radiator 351 is formed at one end of the conductive supporting member 313*c*.

By the first and second radiators 351 and 352 and the conductive loop, implemented is an antenna capable of transmitting and receiving radio electromagnetic waves having multi bands.

Figure 10:
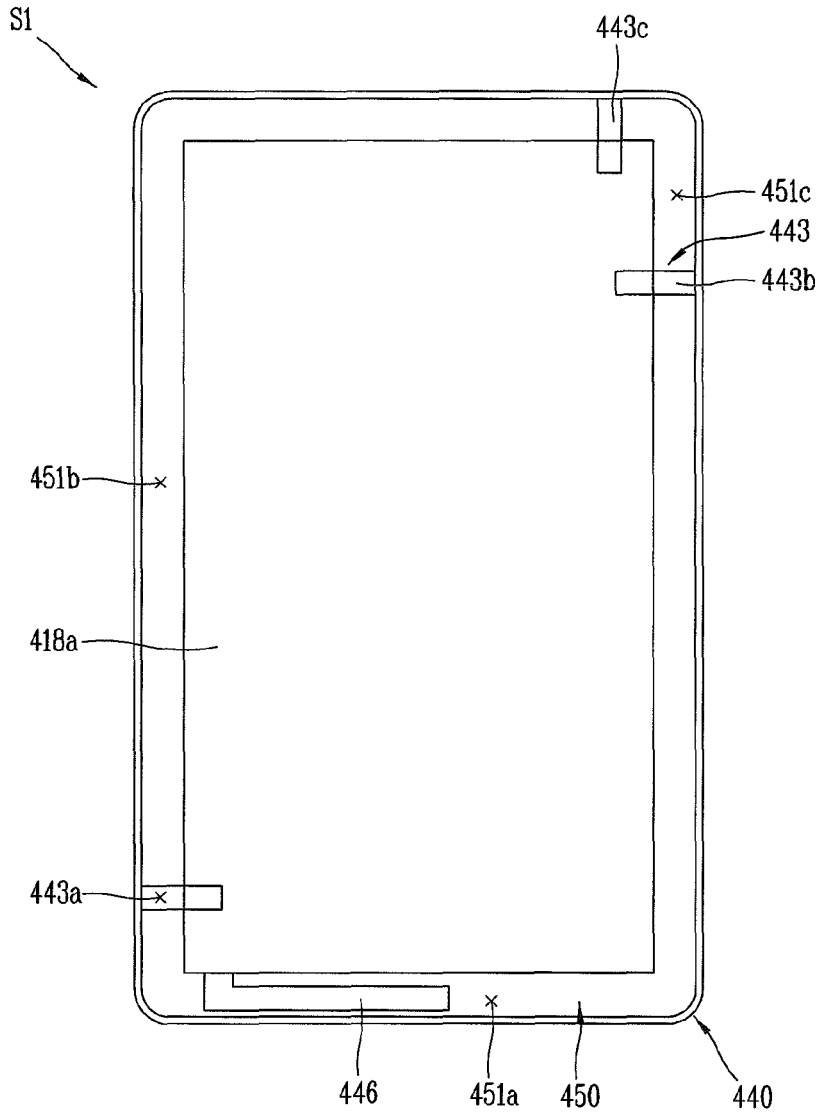
FIG. 10 is a conceptual view of a slot antenna implemented by projecting a conductive frame portion, a ground portion, and a conductive connection portion of FIG. 9 in a direction perpendicular to a display unit.

FIG. 9 is a disassembled view of a first body of a portable terminal according to another embodiment of the present invention, and FIG. 10 is a conceptual view of a slot antenna (S1) implemented by projecting a conductive frame portion 440, a ground portion 418*a*, and a conductive connection portion 443 of FIG. 9 in a direction perpendicular to a display unit.

FIG. 9 shows that an antenna is formed at a first body of a portable terminal.

Referring to FIG. 9, a window 413*b* is mounted to one surface of a front case 411 of a first body 410.

The window 413*b* is formed of a light transmissive material, e.g., a synthetic resin, a reinforcing glass, etc. However, the window 413*b* may be formed to include a non-transmissive region. This non-transmissive region indicates a region formed of a non-transmissive material, or a region surface-processed so as to prevent light from passing therethrough.

The window 413*b* may have an area corresponding to a display module 413*a* so that visual information outputted from the display module 413*a* can be recognized from outside. The display module 413*a* and the window 413*b* are classified into a display unit. Under this configuration, the display unit for displaying visual information is formed at the center of the front case 411.

Referring to FIG. 9, the display module 413*a* may be mounted to a circuit board 418, and the circuit board 418 may be inserted into a rear case 412 of the first body 410. The circuit board 418 may be configured as one example of a controller 170 (refer to FIG. 14) which operates each kind of function of the portable terminal. However, the present invention is not limited to this. The circuit board 418 processes signals corresponding to radio electromagnetic waves transmitted and received by the slot antenna (S1, refer to FIG. 10).

A speaker module 414*a*, a camera module 415*a*, a switch 416*a*, etc. may be mounted to the circuit board 418. The speaker module 414*a*, the camera module 415*a*, the switch 416*a*, etc. are controlled by the circuit board 418, respectively, and are implemented as electronic components for performing functions of the audio output unit 114, the first image input unit 115 or the first manipulation unit 116 (refer to FIG. 14).

The circuit board 418 may be formed in a plurality of layers, and at least one of the plurality of layers may be implemented as a ground portion 418*a* for forming electrical ground of the circuit board 418. The ground portion 418*a* may be formed as a thin film conductive material is coated on a first layer of the circuit board 418 so as to cover a circumferential surface of the circuit board 418.

Referring to FIG. 9, a conductive frame portion 440 is mounted to the front case 411. The conductive frame portion 440 may be formed in a similar manner or in the same manner to or as the conductive member of FIG. 3.

The conductive frame portion 440 is formed along edges of the first body 410. However, the present invention is not limited to this. The conductive frame portion 440 may be internally mounted to the front case 411 so as to reinforce an intensity of the front case 411. Alternatively, as the front case 411 is formed of a conductive material, the conductive frame portion 440 and the front case 411 may be integrated with each other. The conductive frame portion 440 may be formed of a conductive material, e. g, a metallic thin plate formed of gold and copper. The conductive frame portion 440 is formed to encompass the ground portion 418*a* when projected in a direction perpendicular to the display unit.

The conductive frame portion 440 includes side frames 441*a* and 441*b* and a connection frame 442.

The side frames 441*a* and 441*b* are formed along two edges of the display unit. More concretely, the side frames 441*a* and 441*b* are formed in the form of belts extending in a lengthwise direction of the portable terminal so as to cover side surfaces of the first body 410, the surfaces crossing a surface where the display unit is mounted.

The connection frame 442 is formed in a direction crossing the two edges of the display unit, thereby connecting the side frames 441*a* and 441*b* to each other. The connection frame 442 is disposed on a side surface of the first body 410 in a widthwise direction of the portable terminal, and is bent from the side frames 441*a* and 441*b*. And, the connection frame 442 may be integrally formed with the side frames 441*a* and 441*b*.

The conductive frame portion 440 may form a closed loop. More concretely, the connection frame 442 may be provided in plurality in number, thereby connecting both ends of the side frames 441*a* and 441*b*. However, the present invention is not limited to this. For instance, the side frames 441*a* and 441*b* and the connection frame 442 may be formed in a 'U' shape by being combined with one another.

The ground portion 418*a* and the conductive frame portion 440 are electrically connected to each other by a conductive connection portion 443. Referring to FIGS. 9 and 10, the conductive connection portion 443 connects the ground portion 418*a* and the conductive frame portion 440 to each other at a plurality of locations, in order to form a slot 451 together with the ground portion 418*a* and the conductive frame portion 440.

The conductive connection portion 443 is extending from one side of the conductive frame portion 440, and is bent towards the circuit board 418. The conductive connection portion 443 may be configured to contact a connection port 419*a* of the circuit board 418 when the conductive frame portion 440 has been mounted to a case. The connection port 419*a* is electrically connected to the ground portion 418*a* in the circuit board 418. Under this configuration, the conductive connection portion 443 is electrically connected to the ground portion 418*a*.

The conductive connection portion 443 may be implemented as a cantilever capable of being elastically transformed. A fixing end of the cantilever may be one end of the conductive connection portion 443 where the conductive frame portion 440 and the conductive connection portion 443 are connected to each other, and a free end of the cantilever may be another end of the conductive connection portion 443. The conductive connection portion 443 may maintain electric connection to the ground portion 418*a* by elastically pressurizing the connection port 419*a*.

The conductive connection portion 443 connects the conductive frame portion 440 and the ground portion 418*a* to each other so that the slot 451 can be formed in plurality in number. Referring to FIG. 10, the conductive connection portion 443 may consist of first to third connection portions 443*a*, 443*b* and 443*c*. The first slot 451*a* may be formed by the first and second connection portions 443*a* and 443*b*, the conductive frame portion 440 and the ground portion 418*a*. And, the second slot 451*b* may be formed by the first and third connection portions 443*a* and 443*c*, the conductive frame portion 440 and the ground portion 418*a*. When the conductive frame portion 440 forms a closed loop as shown in the drawing, the third slot 454*c* may be formed by the second and third connection portions 443*b* and 443*c*, the conductive frame portion 440 and the ground portion 418*a*.

Referring to FIGS. 9 and 10, a feeding portion 446 configured to feed the slot 450 so that the slot 450 can radiate electromagnetic waves is disposed at the rear case 412. The feeding portion is implemented as a pattern formed of a conductive material, and is electrically connected to the ground portion 418*a*. The feeding portion 446 may be implemented on one surface of the rear case 412 in the form of a pattern so as to be positioned in the slot 450 when projected in a direction perpendicular to the display unit.

The feeding portion 446 is provided with a feeding port 446*a* protruding from one side of the pattern towards the circuit board 418. A feeding connection port 419*b* electrically connected to the feeding port 446*a* is mounted to the circuit board 418. The feeding connection port 419*b* is disposed near one end of the circuit board 418, and is electrically connected to one end of the ground portion 418*a*. This may allow the slot 450 to be fed.

Referring to FIG. 10, as the slot 450 is fed by the feeding portion 446, a current flows along corners of the ground portion 418*a* and the conductive frame portion 440 which define the slot 450. Under this configuration, the slots 451*a*, 451*b* and 451*c* form a slot antenna (S1). The plurality of slots 451*a*, 451*b* and 451*c* may be formed to transmit and receive radio electromagnetic waves having different frequent bands.

For instance, the first and second slots 451*a* and 451*b* may be configured to transmit and receive radio electromagnetic waves having first and second frequency bands. One of the first and second frequency bands may be higher than another of the first and second frequency bands. Each of the first and second slots 451*a* and 451*b* may be formed to have the same length as a ½ wavelength of the first and second frequencies.

For instance, the first frequency band may be less than 1000 Mhz (e.g., 800 Mhz to 1000 Mhz), and the second frequency band may be a frequency band allocated to a Global System for Mobile communication (GSM) scheme.

The second frequency band may be more than 1600 Mhz (e.g., 1600 Mhz to 2200 Mhz). The first frequency band may be a frequency band allocated to a Personal Communication Services (PCS) scheme, and a Wideband Code Division Multiple Access (WCDMA) scheme.

When the conductive connection portion 443 is moved, the length of the slot 450 is varied. This may allow a resonance frequency of the slot antenna (S1) to be easily controlled.

Referring to FIG. 9, the conductive frame portion 440 is covered with an insulating portion 447. The insulating portion 447 is formed of an insulating material, and protects a user from a current flowing on the conductive frame portion 440. For instance, the insulating portion 447 may be implemented as an insulating tape attached to the conductive frame portion 440, or may be implemented as an insulating coating layer coated on one surface of the conductive frame portion 440. Only a part of the insulating portion 447 adjacent to a slot of the conductive frame portion 440 may be formed of an insulating material.

Figure 11:
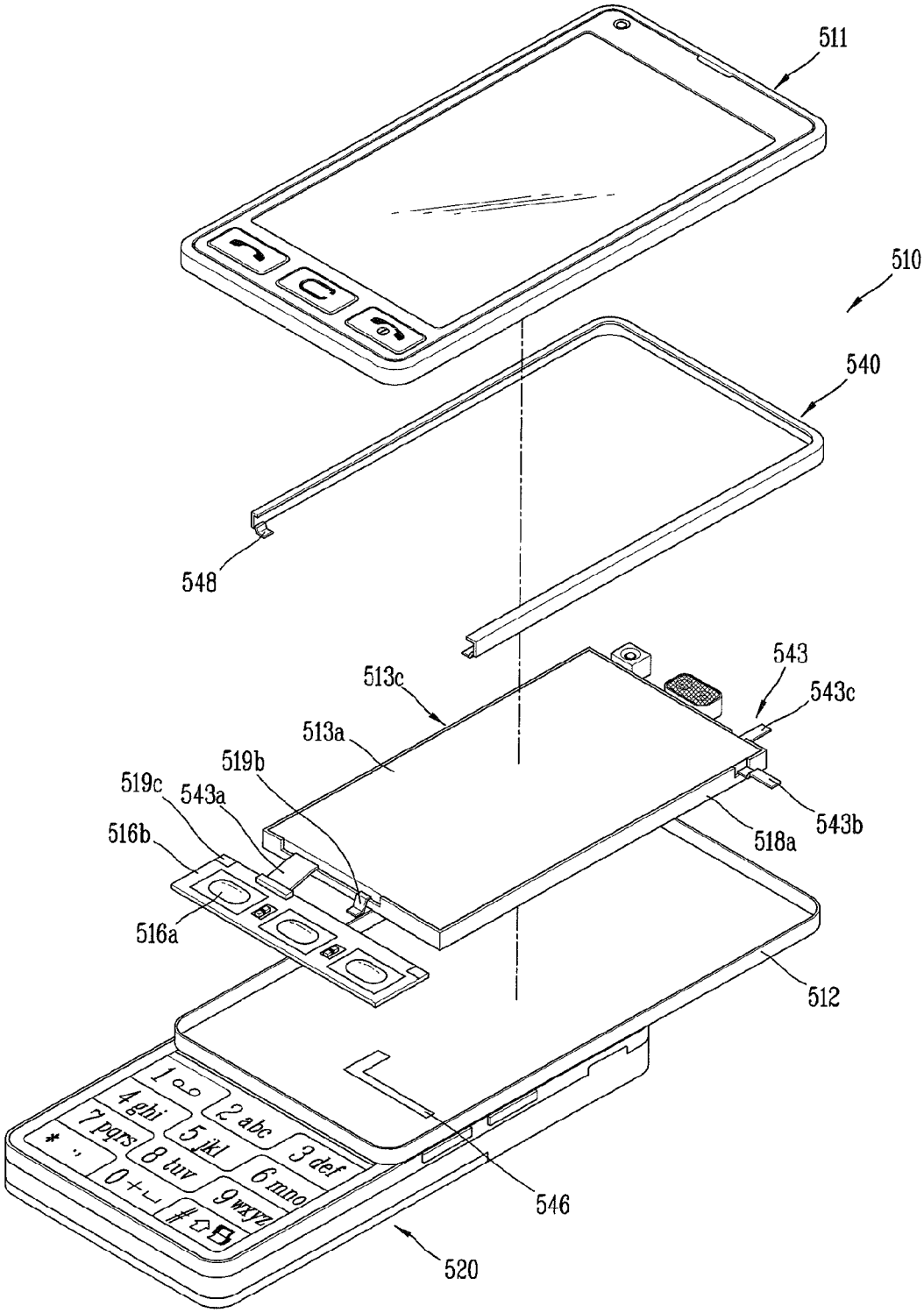
FIG. 11 is a disassembled view of a first body of a portable terminal according to still another embodiment of the present invention.
Figure 12:
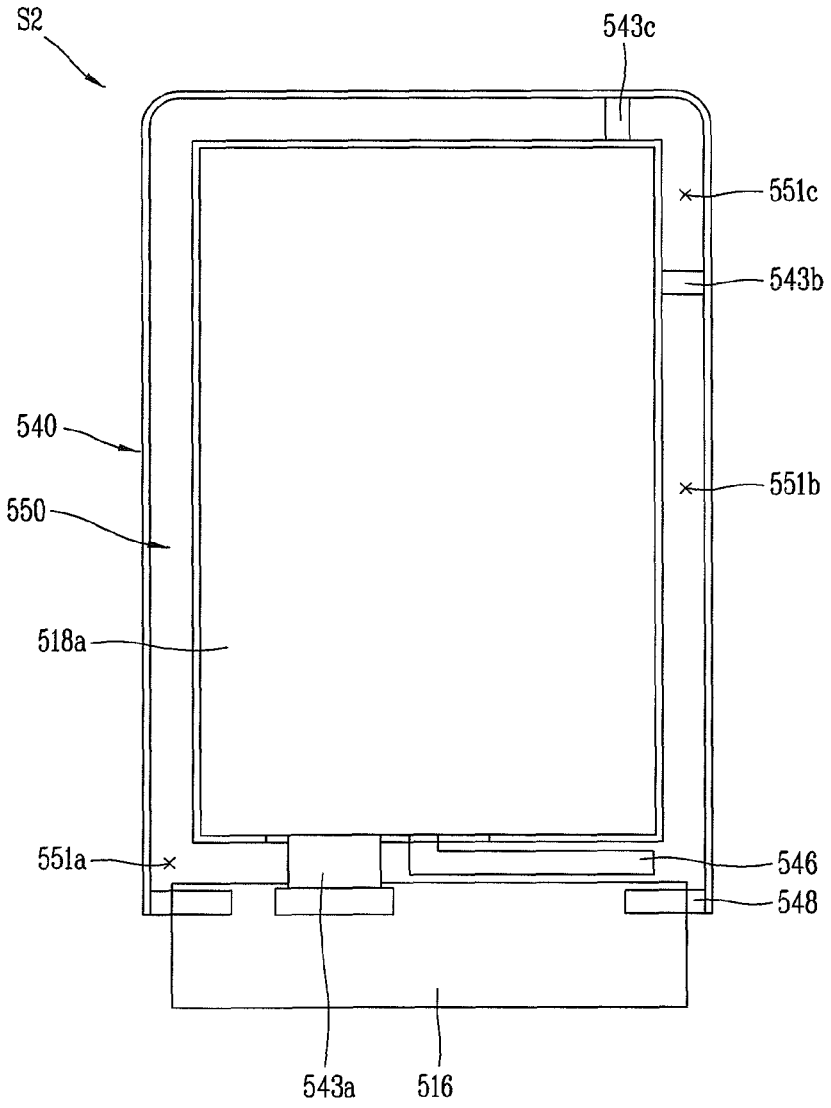
FIG. 12 is a conceptual view of a slot antenna implemented by projecting a conductive frame portion, a ground portion, and a conductive connection portion of FIG. 11 in a direction perpendicular to a display unit.

FIG. 11 is a disassembled view of a first body 510 of a portable terminal according to still another embodiment of the present invention, and FIG. 12 is a conceptual view of a slot antenna (S2) implemented by projecting a conductive frame portion 540, a ground portion 518*a*, and a conductive connection portion 543 of FIG. 11 in a direction perpendicular to the display unit 113 (refer to FIG. 1).

Referring to FIG. 11, a conductive frame portion 540 is mounted to an inner surface of a front case 511 so as to encompass a window 513*b*. The conductive frame portion 540 is formed to reinforce an intensity of the front case 511.

A display module 513*a* is mounted to a rear case 512, and is supported by a conductive member 513*c*. The conductive member 513*c* is formed to cover a rear surface of the display module 513*a*, and has a conductive connection portion 543 at corners thereof. The conductive member 513*c* may be connected to a circuit board (not shown) so as to implement a ground portion 518*a* of the circuit board. The circuit board may be mounted to a second body 520, and may be connected to the conductive member 513*c* through a flexible circuit board, etc. A feeding portion 546 is electrically connected to one side of the conductive member 513*c*. A feeding port 519*b* may be protruding from the conductive member 513*c* so as to contact the feeding portion. Under this configuration, the ground portion 518*a* and the feeding portion 546 are connected to each other.

A switch circuit board 516*b* is disposed near the display module 513*a*. A switch 516*a* is mounted to the switch circuit board 516*b*, thereby forming the first manipulation unit 116 (refer to FIG. 1). The switch circuit board 516*b* is composed of a plurality of layers, and the plurality of layers include a ground layer.

Supplementary connection portions 548 connected to the switch circuit board 516*b* are formed at both ends of the conductive frame portion 540, and connection ports 519*c* electrically connected to the supplementary connection portions 548 are formed at the switch circuit board 516*b*. The connection ports 519*c* are electrically connected to the ground layer.

Referring to FIG. 12, the conductive frame portion 540 and corners of the switch circuit board 516*b* form a closed loop, and the conductive member 513*c* forms the ground portion 518*a*. As the ground portion 518*a* is disposed in the closed loop, slots 551*a*, 551*b* and 551*c* are formed. As the feeding portion 546 feeds the slot 550, a slot antenna (S2) may be implemented. This slot antenna (S2) may allow the portable terminal to have a slimmer antenna.

Figure 13:
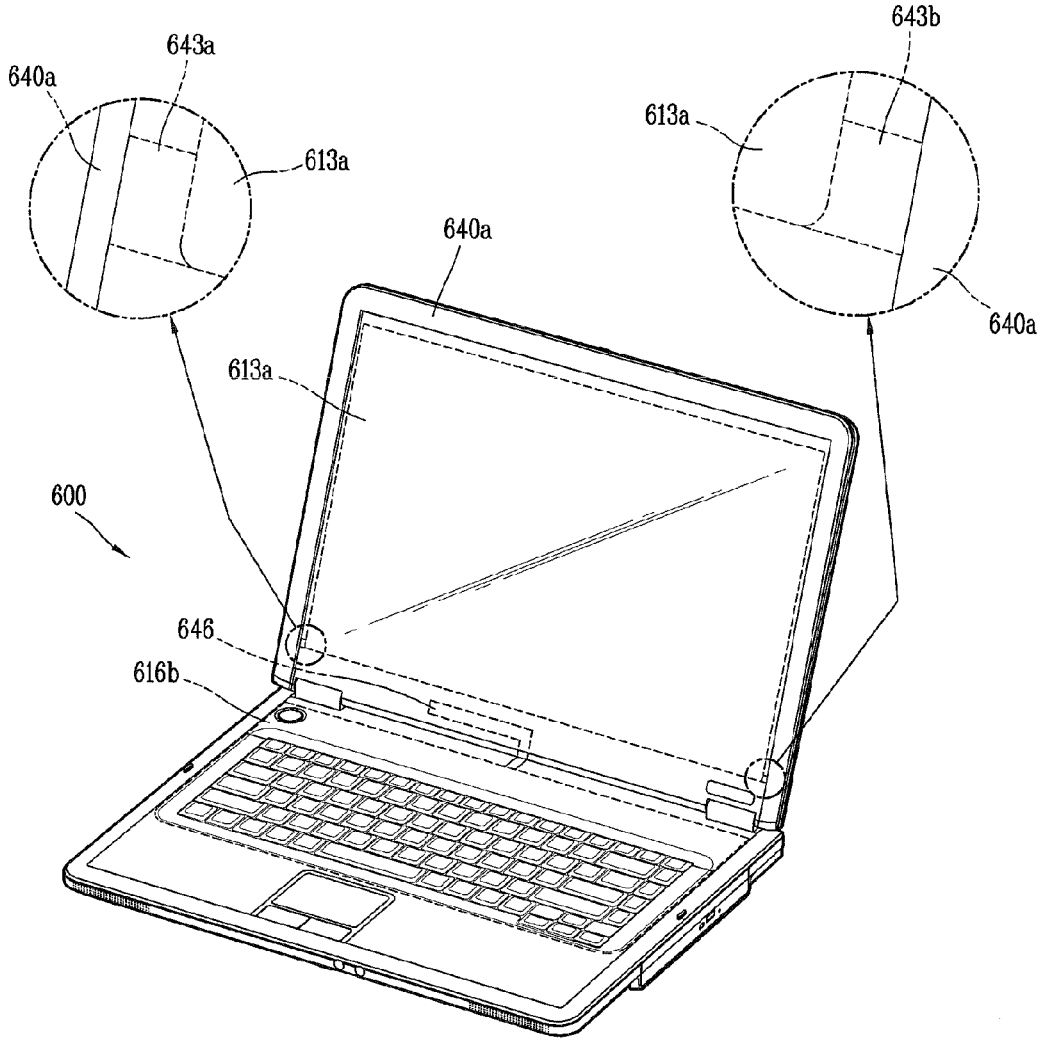
FIG. 13 is a conceptual view of a notebook computer according to another embodiment of the present invention.

FIG. 13 is a conceptual view of a notebook computer 600 according to another embodiment of the present invention.

The notebook computer 600 is implemented as two bodies are rotatably coupled to each other. Each of the two bodies is provided with a display unit and a manipulation unit.

A conductive frame portion 640*a* is formed along a frame of each body. For instance, the conductive frame portion 640*a* formed to correspond to the display unit may be a Bezel configured to support a window.

A ground portion 613*a* is disposed to correspond to the display unit, and may be formed on an LCD substrate. The ground portion 613*a* and the conductive frame portion 640*a* are spacing from each other, and are electrically connected to each other at a plurality of locations by connection portions 643*a* and 543*b*.

A manipulation unit is provided with a keypad circuit board 616*b* disposed below a keypad, and the keypad circuit board 616*b* includes a ground layer. The ground layer is electrically connected to the conductive frame portion 640*a*, and is spacing from the ground portion 613*a* as the keypad circuit board 616*b* is spacing from the ground portion 613*a*.

Under these configurations, the ground portion 613*a* is encompassed by the conductive frame portion 640*a* and the keypad circuit board 616*b*, and forms a plurality of slots. As a feeding portion 646 is disposed at one of the slots, a slot antenna may be implemented. This slot antenna may allow a notebook computer to have a slimmer size.

Figure 14:
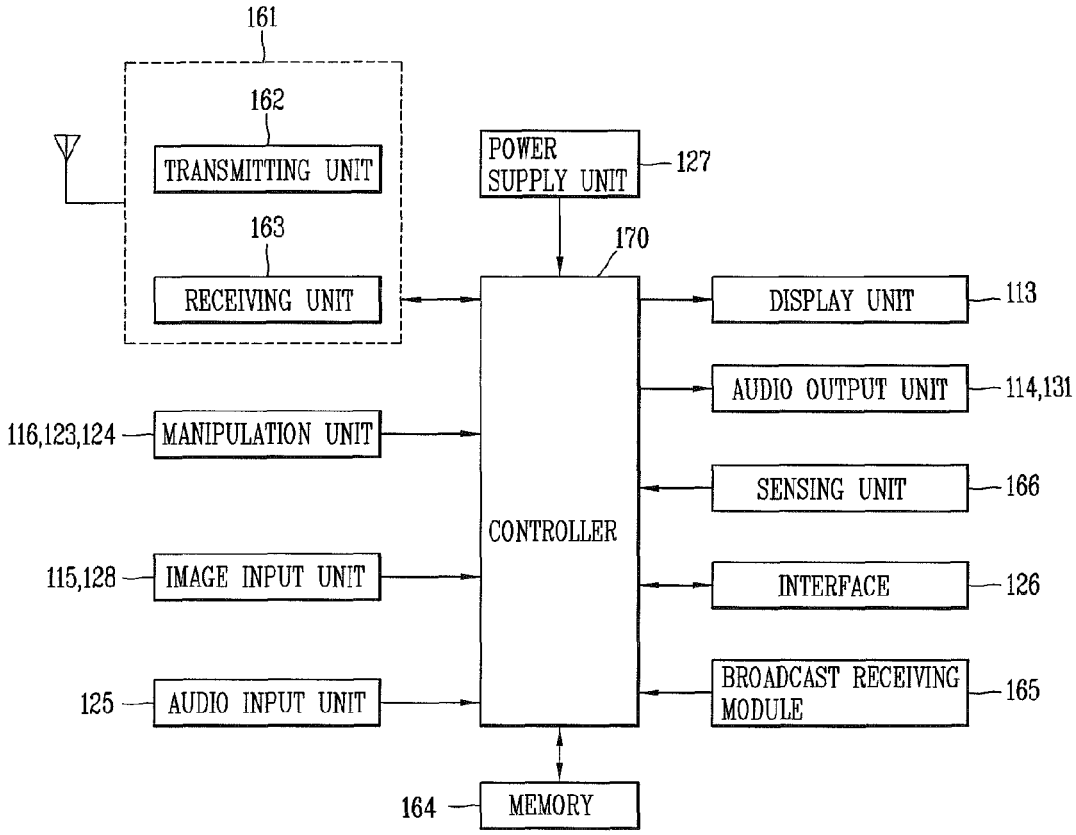
FIG. 14 is a block diagram of a portable terminal according to the present invention.

FIG. 14 is a block diagram of the portable terminal according to the present invention.

Referring to FIG. 14, the portable terminal according to one embodiment of the present invention may comprise components, such as a wireless communication module 161, manipulation units 116, 123 and 124, image input units 115 and 128, an audio input unit 125, a display unit 113, audio output units 114 and 131, a sensing unit 166, an interface 126, a broadcasting signal receiving module 165, a memory 164, a power supply unit 127, and a controller 170.

The controller 170 typically controls the overall operations of the portable terminal. For example, the controller 170 performs the control and processing associated with telephony calls, data communications, video calls, and the like.

Furthermore, the controller 170 not only performs the general functions, but also controls the operation of the portable terminal according to the present invention.

The wireless communications module 161 transmits or receives wireless signals to/from a base station through an antenna. For instance, the wireless communications module 161 transmits or receives voice data, text data, video data, and control data under control of the controller 170. And, the wireless communications module 161 includes a transmitting portion 162 for transmitting a signal through a modulation process, and a receiving portion 163 for demodulating a received signal.

As shown in FIG. 1, the manipulation units 116, 123 and 124 provide, to the controller 170, key input data input by a user so as to control the operation of the portable terminal. The manipulation units 116, 123 and 124 may be implemented as dome switches or a touch pad (e.g., static pressure/capacitance), or a jog wheel or a jog switch.

The image input units 115 and 128 process image frames of still images or moving images captured by an image sensor in a video call mode or a capturing mode. Then, the processed image frames are converted into video data that can be displayed on the display unit 113, and then are output to the display unit 113.

Under control of the controller 170, the image frames processed by the image input units 115 and 128 may be stored in the memory 164, or may be outwardly transmitted through the wireless communications module 161.

The audio input unit 125 receives external audio signals by a microphone in a call mode, or a recording mode, or a voice recognition mode, and so on, and then processes the received audio signals into electric voice data. In the case of a call mode, the processed voice data is converted into data that can be transmitted to the base station through the wireless communications module 161, and then is output to the wireless communications module 161. In the case of a recording mode, the processed voice data is output so as to be stored in the memory 164.

The audio input unit 125 may include assorted noise removing algorithms to remove noise generated in the course of receiving an external audio signal.

The display unit 113 may display information processed in the portable terminal. For instance, when the portable terminal is in a call mode, User Interface (UI) or Graphic User Interface (GUI) relating to a call is displayed under control of the controller 170. When the portable terminal is in a video call mode or a capturing mode, a captured image or UI or GUI is displayed under control of the controller 170. And, when the display unit 13 includes a touch screen, it serves as an input device as well as an output device.

In various modes including a call-receiving mode, a call-placing mode, a recording mode, a voice recognition mode and a broadcast reception mode, the audio output units 114 and 131 convert audio data received from the wireless communication module 161, or audio data stored in the memory 164 thereby to outwardly output under control of the controller 170.

The audio output units 114 and 131 output audio signals relating to functions executed in the portable terminal (e.g., call signal receiving sound, message receiving sound, and so on). The audio output units 114 and 131 include a speaker, a receiver, a buzzer, and so on.

The sensing unit 166 senses the current status of the portable terminal such as an open/close status of the portable terminal, a position of the portable terminal, and presence or absence of a user's contact with the portable terminal, thereby generating sensing signals to control the operation of the portable terminal. As an example, when the portable terminal is a slide-type portable terminal, the sensing unit 166 may sense whether a sliding portion of the portable terminal is open or closed. Then, the sensing unit 166 outputs results of the sensing to the controller 170, and thereby the operation of the portable terminal is controlled. Other examples include the sensing unit 166 sensing the presence or absence of power provided by the power supply unit 127, the presence or absence of coupling or other connection between the interface 126 and an external device, and so on. The interface 126 interfaces a wire/wireless headset, an external charger, a wire/wireless data port, and a card socket (e.g., memory card, SIM/UIM card) rather than the portable terminal, with all types of external devices connected to the portable terminal. The interface 126 receives data or power from an external device, and transmits it to each component inside the portable terminal. Otherwise, the interface 126 transmits data inside the portable terminal to an external device. The memory 164 may store a program to activate the controller 170, or may temporarily store input/output data (e.g., phonebook, messages, still images, moving images, and so on).

Furthermore, the memory 164 stores a program for controlling the operation of the portable terminal of the present invention.

The memory 164 includes the concepts of the general hard disc, card-type memory (e.g., SD or XD memory), flash memory, RAM, ROM, and so on.

The broadcasting signal receiving module 165 receives a broadcasting signal transmitted through satellite or terrestrial waves, etc., and converts the signal into broadcasting data that can be output to the audio output units 114 and 131, and the display unit 113 thereby to output it to the controller 170. The broadcasting signal receiving module 165 receives broadcasting-related additional data (e.g., Electric Program Guide: EPG, channel list, etc.). Broadcasting data and additional data converted by the broadcasting signal receiving module 165 may be stored in the memory 164.

The power supply unit 127 receives external or internal power under control of the controller 170, and supplies the power to each component of the portable terminal.

The portable terminal according to the present invention has the following advantages.

Firstly, an antenna capable of transmitting and receiving radio electromagnetic waves having multi bands is implemented by forming a conductive loop by using the conductive member. The conductive member may reinforce an intensity of the body.

Secondly, the portable terminal is provided with a monopole antenna and a dipole antenna by combining the conductive loop and the radiator with each other. This may allow the portable terminal to be slimmer.

Thirdly, a slot antenna may be implemented through the conductive frame portion. This may allow an antenna of the portable terminal to be slimmer.

Fourthly, radio electromagnetic waves having multi bands are transmitted and received by forming a plurality of slots.

Fifthly, an antenna capable of easily controlling a resonance frequency is implemented by changing a length of the slot by moving the conductive connection portion.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal, comprising:

a ground portion mounted in a body of the portable terminal, and configured to form electrical ground of a circuit board which controls the portable terminal;

a conductive member mounted to a case which forms appearance of the body, and formed of a conductive material;

a first radiator electrically connected to the ground portion so as to be fed by the ground portion, and configured to transmit and receive radio electromagnetic waves;

a second radiator formed of a conductive material, and connected to the conductive member so as to form an antenna pattern together with the ground portion and the conductive member, the antenna pattern consecutive with a feed point of the first radiator; and a connection member configured to electrically connect edges of the ground portion to the conductive member such that the first radiator and the antenna pattern form a dipole antenna.

2. The portable terminal of claim 1, wherein the corners of the ground portion, the conductive member and the connection member form a conductive loop.

3. The portable terminal of claim 2, wherein the conductive loop forms a closed loop, and the first and second radiators are connected to different parts of the closed loop.

4. The portable terminal of claim 2, wherein the conductive loop transmits and receives radio electromagnetic waves of a frequency band different from that of the dipole antenna by being combined with the first radiator.

5. The portable terminal of claim 3, further comprising a third radiator electrically connected to the conductive loop so as to form an antenna together with the first radiator, the antenna configured to transmit and receive a frequency band different from that of the dipole antenna.

6. The portable terminal of claim 1, wherein at least one of the first and second radiators is implemented on a surface of the case in the form of a pattern.

7. The portable terminal of claim 1, wherein the connection member is protruding from the conductive member, and elastically pressurizes a connection port provided at the circuit board.

8. The portable terminal of claim 1, wherein the ground portion includes a conductive supporting member configured to support a display module which displays image information, wherein the conductive supporting member is provided with a connection port electrically connected to the connection member.

9. The portable terminal of claim 1, wherein the conductive member is formed along edges of the body so as to form a frame of the body.

10. A portable terminal, comprising:

a body having a display unit for displaying image information;

a ground portion configured to form electrical ground of a circuit board which controls the display unit;

a conductive frame portion mounted to a case which forms appearance of the body, and formed along edges of the body;

a conductive connection portion configured to connect the ground portion and the conductive frame portion to each other at a plurality of locations so as to form slots defined by the ground portion and the conductive frame portion; and a feeding portion configured to feed the slot such that the slot radiates electromagnetic waves.

11. The portable terminal of claim 10, wherein the conductive frame portion is formed to encompass the ground portion when projected in a direction perpendicular to the display unit.

12. The portable terminal of claim 11, wherein the conductive frame portion includes:

side frames formed along two edges of the display unit; and a connection frame formed in a direction crossing the two edges of the display unit, and configured to connect the side frames to each other.

13. The portable terminal of claim 12, wherein the conductive frame portion forms a closed loop.

14. The portable terminal of claim 10, wherein the ground portion is formed at the circuit board, or at the conductive member which supports a display module.

15. The portable terminal of claim 10, wherein the conductive connection portion connects the conductive frame portion and the ground portion to each other such that the slot is formed in plurality in number.

16. The portable terminal of claim 15, wherein the plurality of slots are formed to transmit and receive radio electromagnetic waves of different frequency bands.

17. The portable terminal of claim 10, wherein the conductive connection portion is extending from the conductive frame portion, and elastically pressurizes the connection port provided at the circuit board.

18. The portable terminal of claim 10, wherein the feeding portion is implemented as a pattern formed of a conductive material, and is electrically connected to the ground portion.

19. The portable terminal of claim 10, further comprising an insulating portion configured to cover the conductive frame portion, and formed of an insulating material.

* * * * *